United States Patent [19]

Bandy, Jr.

[11] 4,129,265

[45] Dec. 12, 1978

[54] REELED WEB UNWIND STAND

[75] Inventor: Clarence L. Bandy, Jr., Fayetteville, W. Va.

[73] Assignee: Westvaco Corporation, New York, N.Y.

[21] Appl. No.: 896,171

[22] Filed: Apr. 14, 1978

[51] Int. Cl.[2] ..... B65H 19/12

[52] U.S. Cl. ..... 242/58.2; 242/56 A

[58] Field of Search ..... 242/58.1, 58.2, 58.3, 242/58.4, 56 A, 56 R

[56] References Cited

U.S. PATENT DOCUMENTS

| | | | |
|---|---|---|---|
| 1,933,886 | 11/1933 | Wood | 242/58.2 |
| 2,000,809 | 5/1935 | Wood | 242/58.2 |
| 2,320,657 | 6/1943 | Roesen | 242/58.2 |
| 2,320,658 | 6/1943 | Roesen | 242/58.1 |
| 2,386,345 | 10/1945 | Roesen | 242/58.2 |
| 3,813,052 | 5/1974 | Swann | 242/58.3 |

*Primary Examiner*—Edward J. McCarthy
*Attorney, Agent, or Firm*—W. Allen Marcontell; Ernest B. Lipscomb, III

[57] ABSTRACT

A continuous web converting machine is supplied with web material from a spider wheel unwind stand having a shiftable wheel axis. Movement of the spider wheel axis is regulated by a double acting fluid cylinder for controlled force application of the working web supply reel against a closed circuit pulling belt. Depletion of the working reel is detected by a limit switch actuated by contact with the shift carriage. Upon working reel depletion, the pressure bias on the fluid cylinder is reversed and the shift carriage retracted to free the working reel from contact with the pulling belt. Thereafter, the spider wheel is rotatively indexed 120° to align a full working reel and the shift carrier advanced until the full working reel bears into the pulling belt with the desired pressure.

7 Claims, 7 Drawing Figures

REELED WEB UNWIND STAND

BACKGROUND OF THE INVENTION

1. Field Of The Invention

The present invention relates to methods and apparatus for the continuous supply of reeled web material such as paper or textiles into a continuous converting machine.

2. Description Of The Prior Art

Continuous web converting machines such as printing presses and cutter/slitters are generally constructed to draw material from a supply reel.

So as to expedite the transition from a depleted reel to a full reel, spider wheel turret mechanisms are used such as that disclosed by O. C. Roesen in his U.S. Pat. No. 2,320,658.

To level the inertial forces as a web is unreeled, it is known to use a closed circuit pulling belt bearing against a small arcuate portion of the active reel. The belt is independently driven thereby driving the active reel at a substantially constant surface velocity.

Due to the fact that the reel diameter diminishes as it is depleted of web, it is necessary to accommodate such dimension changes in a manner consistent with the constant surface velocity. Furthermore, in the case of extremely soft web reels such as creped paper, certain textiles and the like, it is also necessary to maintain a light, carefully controlled bearing force against the reel.

Normally, these operational constraints are accommodated by the use of weighted or spring loaded dancer rolls in the pulling belt circuit. These devices maintain a constant belt tension notwithstanding geometric changes in the circuit.

When the dancer roll pulling belt system is used in combination with a spider wheel unwind stand, an unusually large change in circuit geometry must be accommodated due to the arcuate sweep of the spider wheel about a fixed spider wheel axis.

Consequently, the magnitude of machine length and volume to accommodate the increased dancer roll stroke is proportionately increased. In some instances, as in the case of Roesen patent disclosure, supra, the pulling belt unit of the machine is so large as to be positioned beyond the reel unwind stand from the converting machine, per se. This arrangement severely restricts operator accessibility of the unwind stand for loading and unloading.

It is an object of the present invention therefore to reduce the size and complexity of a pulling belt unit for use in combination with a spider wheel unwind stand.

Another object of the present invention is provision of a constant force loading system of a supply reel against the pulling belt having sufficiently large stroke capacity to accommodate a spider wheel unwind stand.

SUMMARY OF THE INVENTION

The spider wheel unwind stand of the present invention includes a longitudinally shiftable carriage for the spider wheel rotational axle. Movement of such carriage and hence, the spider wheel axle, is controlled by a linear motor such as a double acting piston and cylinder. Fluid control over the linear motor includes close order pressure regulation of the in-feed stroke of the piston to maintain a substantially constant bearing pressure of an active web feed reel against the pulling belt. In the opposite direction, the fluid motor strokes to shift the spider wheel carriage out of bearing contact between the pulling belt and the depleted reel.

A different drive is used to power rotation of the spider wheel and limit switches set to the physical position of the shift carriage and the spider arms control the functional sequence of the two motors.

The pulling belt unit used in cooperation with the present unwind stand is a basic closed course belt drive without dancer rolls or other course geometry change accommodations. Belt material is selected by the degree reel wrap desired and the tensile yield characteristic of the material.

BRIEF DESCRIPTION OF THE DRAWING

Relative to the drawing wherein like reference characters are used throughout the several figures to designate like or similar elements.

DESCRIPTION OF THE PREFERRED EMBODIMENT

Figure 1:
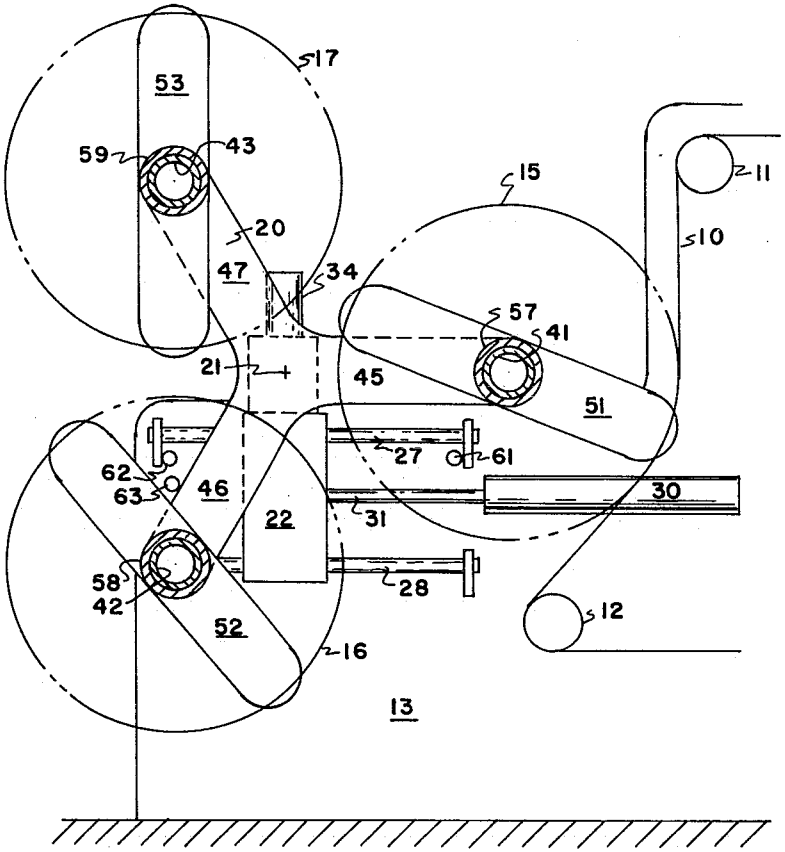
FIG. 1 is an elevational profile of the invention as sectioned along cut line I-I of FIG. 2.
Figure 2:
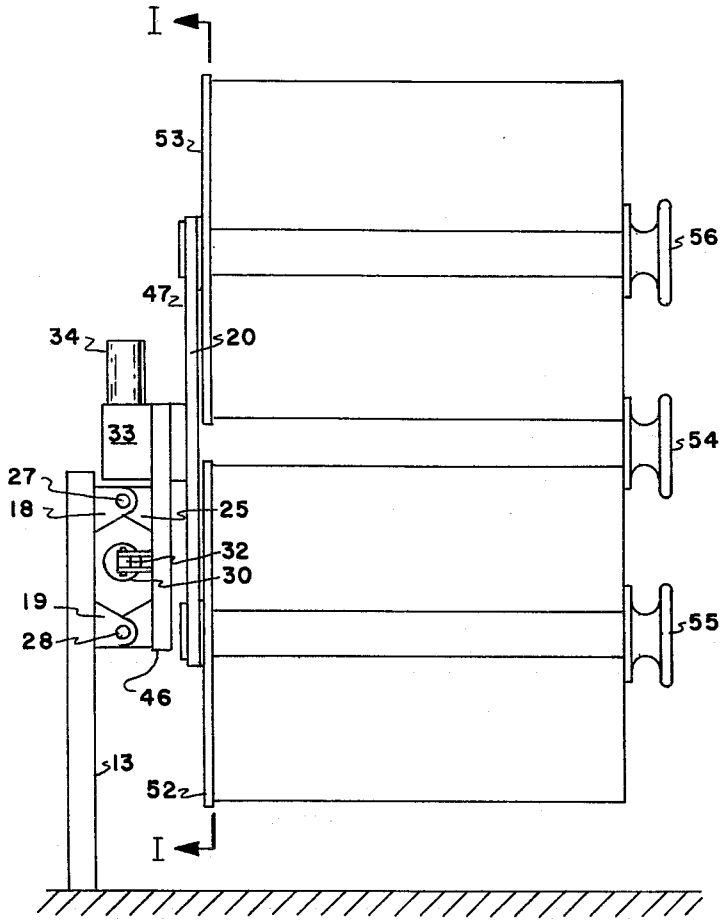
FIG. 2 is an elevational end view of the present invention.

Giving initial reference to FIGS. 1 and 2 of the drawing, the present unwind station is disposed at the web supply end of a suitable converting machine such as a slitter/rewinder or printing press not shown. An endless pulling belt 10 coursed around turning rolls 11 and 12 is drawn over an arcuate surface portion of an active web supply reel 15 thereby rotating the reel and carrying unwinding web into the first operating station of the converting machine. Since the pulling belt 10 tension is controlled by a reel in-feed mechanism, to dancer rolls, tension weights or other such means are required for the pulling belt 10. Accordingly, very little machine space is required for the pulling belt unit.

The unwind turret of the present invention basically comprises a spider wheel 20 mounted for selectively driven rotation about a spider axis 21. Supporting the spider axis 21 is a shift carrier 22 having linear bearing mounts 25 and 26 for each of two guide bars 27 and 28. The guide bars 27 and 28 are rigidly secured to a frame side panel 13 by means of brackets 18 and 19.

Also secured to the shift carrier 22 by means of a clevis joint 32 is the rod end 31 of a reversible fluid motor such as a double acting air cylinder 30. The base of this shift cylinder is secured to the frame panel 13. A pressure controlled air supply, not shown, powers the cylinder 30. Appropriate fluid controls are provided to rapidly expand the rod 31 from the cylinder 30 for retraction of the spider unit 20 away from the pulling belt 10. Close order pressure control over the piston/cylinder contraction regulates the magnitude of tension within the pulling belt 10 as the working web supply reel 15 diminishes in circumference.

Rotation of the spider wheel 20 is controlled by means of a worm drive reduction gear unit 33 driven by motor 34.

At the distal end of each spider arm 45, 46 and 47 is provided a rotatable reel mandrel 41, 42 and 43. Secured to the reel mandrels at the hub end next to the respective spider arm for rotation with the mandrel are flange plates 51, 52 and 53. Manually detachable end plates 54, 55 and 56 are provided on the free end of the cantilevered mandrels 41, 42 and 43 to secure the lateral positionment of a web reel along the mandrels between the flange plates and end plates.

Figure 3:
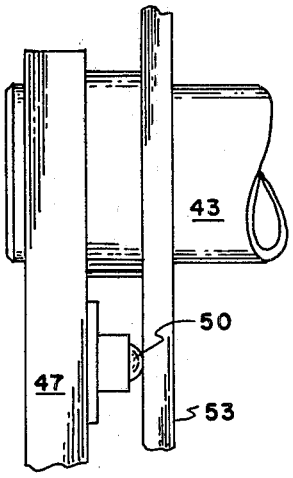
FIG. 3 is a detail of a suitable detent mechanism used with the invention.

A rotational inhibiting device such as detent mechanism 50 shown in FIG. 3 is disposed between each spider arm 47 and the respective flange plate 57. The mechanism illustrated comprises a caged, spring biased ball member secured to the spider arm and a socket in the flange plate. Alternatively, a simple spring blade secured to the spider arm having sufficient length for light flexure against the flange plate may be sufficient.

Web winding cores 57, 58 and 59 are shown by FIG. 1 in operative position about respective mandrels for descriptive clarity. Normal industry practice is to wind a continuous length of web about such cores 57, 58 and 59 for handling and shipment.

Figure 4A:
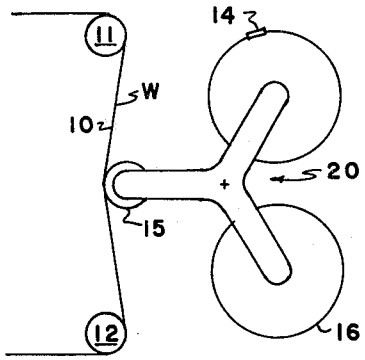
FIGS. 4A–4D are sequential operation schematics representative of the invention operating cycle.

Operational and positional sequence over the present invention is controlled by three limit switches 61, 62 and 63 which initiate respective fluid and electrical power responses. Limit switch 61 is positioned stationarily relative to the frame 13 for closure by physical contact with a portion of the shift carrier 22. Exact positionment of the switch 61 is determined by the location of shift carrier 22 when a working web reel 15 is substantially depleted. This condition is represented by FIG. 4A at which time the dependent converting machine is stopped and the fluid controls over cylinder 30 are switched to the retraction mode.

Figure 4B:
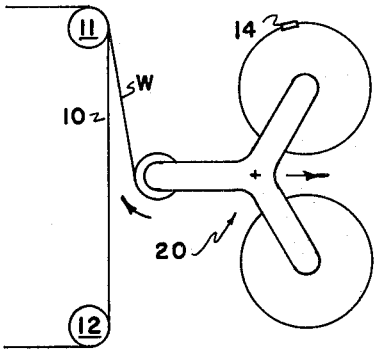

FIG. 4B illustrates the spider wheel 20 in the full retracted position whereat the limit switch 62 is closed to start drive motor 34 thereby causing rotation of the spider wheel 20 as illustrated by FIG. 4B.

Element 14 throughout FIGS. 4A–4D represents a strip of double face adhesive tape applied to the leading edge of the web W wound as reel 17. When the full reel 17 is placed on the mandrel 43, the reel is rotated relative to the mandrel and backing flange 53 so that the web leading edge may be retained in the approximate position indicated. The detent element 50 bearing on the flange plate 53 prevents the assembly from rotating away from the set position due to imbalance. A spot of viscous grease or similar tacky substance between the web leading edge and the previous wrap will prevent the leading edge from sliding off the index position as the spider rotates the full reel into the pulling belt 10.

Figure 4C:
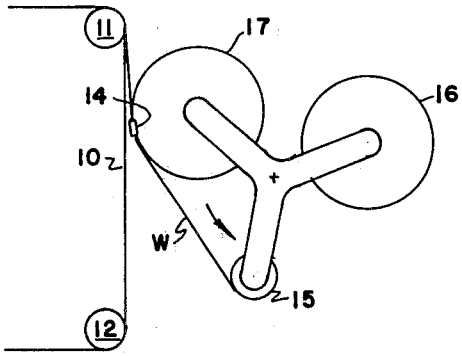
Figure 4D:
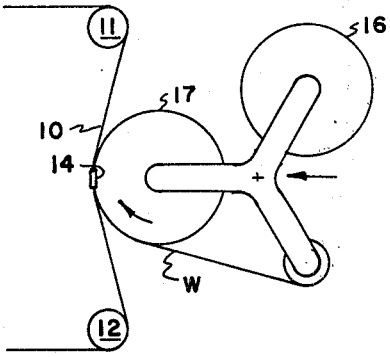

To be noted from FIG. 4C is the angular position of the full reel 17 relative to the corresponding spider arm 47 when the surface profile of the full reel tangentially contacts the remaining tail of web W on depleted reel 15. The index location of adhesive strip 14 should be in the proximity of this point of tangential contact so as to be firmly pressed into the web tail W upon completion of the spider rotation.

Such spider 20 rotational completion is signaled by the closure of limit switch 63 triggered by passage of one spider arm whereupon the converting machine is returned to the running mode and the cylinder 30 is contracted to draw the surface of full reel 17 into the pulling belt 10 with a discretely measured bearing force determined by the standing pressure within cylinder 30.

The web tail remaining on depleted reel 15 may be severed by convenient prior art means or allowed to run out contiguously with the full reel web as dictated by the task requirements.

Having fully described my invention.

I claim:

1. A method of supplying web material to a converting machine from a reel of same rotatively secured to a reel axle mounted at the distal end of a spider frame arm unwind stand, said spider frame being rotatively secured to a shift carriage, said method comprising the steps of:

A. Loading an active web supply reel on one spider arm against the face of a powered pulling belt with a controlled force applied to said shift carriage until said active reel is substantially depleted of said web;

B. Detecting the approach of the web tail from said active reel prior to complete depletion;

C. Stopping the supply of said reel to said converting machine;

D. Withdrawing said active reel from contact with said pulling belt by movement of said shift carriage;

E. Applying a strip of double faced tape to the leading edge of a full reel of said web material;

F. Restraining the rotation of said full reel about said reel axis at a predetermined angular position of said tape strip;

G. Rotating said spider frame until said tape strip on said full reel engages a portion of web drawn from said active reel;

H. Moving said shift carriage to engage said active reel web between said pulling belt and said tape strip; and I. Resuming web supply to said converting machine whereby said full reel becomes the active reel.

2. A reeled web material unwind stand having spider wheel means mounted for rotation about a spider axis, said wheel means comprising a plurality of spider arm means radiating from said axis, each of said arm means having axially elongated reel mandrels secured to distal ends thereof parallel with said spider axis, the improvement comprising shift carriage means supporting said spider wheel means for reciprocable planar movement of said spider axis.

3. Apparatus as described by claim 2 wherein the improvement further comprises force controlled carriage power means for moving said spider wheel means into a web pulling means with a regulated magnitude of force against said pulling means and for retreating said spider wheel therefrom.

4. Apparatus as described by claim 3 wherein the improvement further comprises spider wheel rotational power means for rotating said spider wheel about said axis.

5. Apparatus as described by claim 4 wherein the improvement further comprises first control means for detecting the approach of web end tail wound about a reel pressed against said web pulling means, said first control means causing said carriage power means to retract said spider wheel means from said web pulling means.

6. Apparatus as described by claim 5 wherein the improvement further comprises second control means for causing said rotational power means to turn said spider wheel means about said spider axis by an angular arc between adjacent spider arm means when said spider wheel means is retracted from said web pulling means by a predetermined magnitude.

7. Apparatus as described by claim 6 wherein the improvement further comprises third control means for causing said carriage power means to return said spider wheel into said web pulling means when said angular arc of rotation is complete.

* * * * *